United States Patent [19]

Hugosson et al.

[11] 4,188,458

[45] Feb. 12, 1980

[54] PROTECTIVE COATING ON A STEEL SURFACE

[75] Inventors: Evald Hugosson, Sankt Olof; Anders Kullendorf, Finspong, both of Sweden

[73] Assignee: Stal-Laval Turbin AB, Sweden

[21] Appl. No.: 785,155

[22] Filed: Apr. 6, 1977

[30] Foreign Application Priority Data

Apr. 8, 1976 [SE] Sweden ..... 7604116

[51] Int. Cl.[2] ..... B32B 15/18

[52] U.S. Cl. ..... 428/556; 428/679; 428/626; 428/656; 428/685; 428/682; 428/686; 428/925; 428/926; 428/937

[58] Field of Search ..... 428/679, 926, 925, 682, 428/626, 683, 625, 937, 686, 684, 678, 685

[56] References Cited

U.S. PATENT DOCUMENTS

| | | | |
|---|---|---|---|
| 2,490,978 | 12/1949 | Osterheld | 428/937 |
| 3,245,577 | 4/1966 | Virzi | 428/937 |
| 3,915,666 | 10/1975 | Veitl et al. | 428/926 |
| 3,944,396 | 3/1976 | Chivinsky | 428/679 |

*Primary Examiner*—M. J. Andrews

*Attorney, Agent, or Firm*—Pollock, Vande Sande & Priddy

[57] ABSTRACT

Steel surfaces are protected from erosion and corrosion by a coating which includes at least three metallic layers of increasing normal potential from the base layer lying on the steel surface to that layer farthest from the steel surface. Also, the base layer immediately adjacent the steel surface has approximately the same normal potential as the steel surface.

25 Claims, No Drawings

PROTECTIVE COATING ON A STEEL SURFACE

BACKGROUND OF THE INVENTION

The present invention is concerned with protecting steel surfaces from erosion and corrosion.

Steel surfaces when exposed to hot moist steam are particularly vulnerable to attack and deterioration by erosion and corrosion. This is an espcially serious problem in large plants such as nuclear power plants. Accordingly, it is desirable to protect such steel surfaces to at least retard erosion and corrosion effects.

Protective coatings to be efficient and effective for such purpose must satisfy a number of conditions. In particular, to be efficient a protective coating must have sufficient hardness and sufficient chemical resistance. Further it must have sufficient toughness to be able to resist the thermal stresses. Also, it must satisfactorily bond to the base material (e.g., the steel surface).

The protective coating should also form a layer which is sufficiently tight and substantially free from pores so as to prevent chemically active materials from penetrating into the base material.

As far as the above-discussed properties are concerned, the ceramic coating described in the above-mentioned Swedish patent application is in many respects satisfactory. However, the toughness of the ceramic coating is not sufficient since the material is so brittle that it may be destroyed by drip erosion in exposed places, with resultant risks of corrosive attacks on the damaged spots.

A metallic coating with sufficiently high normal potential could, in principle, fulfill all conditions. However, since such a coating must have a relatively high normal potential in relation to the base material, relatively slight damage or even pores in the layer may cause serious galvanic corrosion on the base material.

It is therefore an object of the present invention to provide a protective coating for steel surfaces which avoid the above drawback of using a metallic coating with a relatively high normal potential.

SUMMARY OF THE INVENTION

The present invention is directed to protecting steel surfaces such as those which are exposed to some kind of erosion or corrosion from hot moist steam in turbine plants and particularly in nuclear power plants by providing a protective coating of at least three different layers of different normal potential wherein the normal potential increases from the base layer lying on the steel surface to the layer which is farthest from the steel surface.

The normal potential of the base layer is approximately the same as the normal potential of the steel surface. The term "normal potential" as used herein means the same as electrode potential, such as discussed on pages 207–209, Chapter 12, Electrolysis and the Electrolytic Dissociation Theory, of Modern Inorganic Chemistry.

As discussed therein, the production of the current in a simple cell is seen to be a result of the tendency of a metal such as zinc in the atomic state to go into solution as ions such as zinc ions. The production of the current in a simple cell is seen to be a result of the tendency of a metal zinc in the atomic state to go into solution as zinc ions. In order that a current may be driven around a circuit, there must be a difference of potential between the poles of the cell. Even when no current is flowing, a difference of potential is found to exist and in these circumstances it is called the electromotive force or E.M.F. of the cell. Experiment has shown that the value of the E.M.F. of a cell depends upon the nature of the substances forming its poles and, to a lesser extent, on the concentration of the solution in which they are immersed. Thus, for example, a cell consisting of zinc and copper plates immersed in a decinormal solution of sulphuric acid has an E.M.F. of about 1.1 volts; if an iron plate be substituted for the zinc one the E.M.F. falls to about 0.67 volt. It can be shown that, in general, a potential difference exists between the metal and a solution containing ions of this metal in reversible equilibrium with it. When the concentration of the ions is 1 gm.-ion per liter this potential difference is called the electrode potential of the metal. By measuring the E.M.F. of a cell composed of such an electrode as one pole and a standard electrode as the other the values of the electrode potentials of the various metals, and the like can be determined. For this purpose the electrode potential of a hydrogen electrode is arbitrarily assumed to be zero. (A hydrogen electrode consists of a plate of platinized platinum immersed in a solution of hydrochloric acid containing 1 gm. of hydrogen ion per liter, over which pure hydrogen at 760 nnn. is bubbled.) The electrode potential is positive when the substance of which the electrode is composed is positively charged with respect to the solution, and vice versa. A table giving a list of the elements in order to their electrode potentials is known as the electrochemical series of the elements.

By means of the gradual increase of the normal potential from the base material (e.g., steel surface) via a base layer and an intermediate layer to the surface layer, the tendency to galvanic corrosion is reduced and particularly when the normal potential of the surface layer is not higher than that which is required to prevent corrosion under the expected conditions of use. In this way the potential steps between the various steps may be held within close limits. Furthermore, the three layers of different material reduce the probability of continuous pores provided the different layers have reasonable thicknesses.

As a further means of sealing the coating it is possible to cover it with a well-penetrating sealing agent in the form of a varnish, which satisfactorily fills up the pores in the metallic coating even if the material outside the metallic coating is worn off rather quickly.

The several layers are preferably applied by thermal spraying, for instance, spraying under flame or plasma conditions.

Metals or alloys are employed as the materials for the different layers. For each layer there may be used particularly suitable base materials which, by means of suitable alloying metals if needed, are set at such a normal potential that desired relative normal potential and good adherence are achieved between the different layers. It is essential that the normal potential always increases and never decreases from the steel surface to the surface layer (i.e., third metallic layer). As a matter of fact, the intermediate and the surface layer may be rather near each other provided that the normal potential of the intermediate layer does not exceed that of the surface layer. If desired, there can be equidistant normal potential levels between the three layers. In other words, of the total increase of normal potential from the steel surface to the surface layer, about one third is provided by the base coating, about one third by the intermediate layer, and about one third by the top coat.

DESCRIPTION OF PREFERRED EMBODIMENTS

The base layer or layer which is directly adjacent the steel surface can be regarded as an adhesive for attaching the other two layers to the steel surface. The normal potential of the base layer should be as near as possible to the steel surface. Also it should be suitable for thermal spraying and should possess the needed adhesive characteristics.

Examples of some suitable materials for the base layer include nickel-aluminum alloy which upon coating forms nickel aluminide ($Ni_3Al$), nickel per se, and molybdenum per se. It is understood that the above materials can and usually will include normal impurities.

The preferred base layer material is $Ni_3Al$. It has an adhesive strength of about 20% greater than the other base materials discussed hereinabove.

Since the base layer acts as an adhesive, it desirably should cover the steel surface sufficiently and suitably with a rather rough layer, but should not be too thick. The thickness of the base layer can be up to about 100 microns, preferably about 10 to about 100 microns and most particularly is about 10 to about 50 microns.

The intermediate layer or next layer out from the steel surface has a normal potential higher than the base layer and desirably slightly higher than cast iron (see Table 23-1 on page 23-3 of Chemical Engineer's Handbook, 5th Edition, Perry, McGraw-Hill, which shows an anodic-cathodic series of various metals). The intermediate layer is preferably a chromium steel containing 10–15% chromium and most preferably containing about 13% chromium (e.g., 12–14% chromium). A typical suitable chromium -13 steel is Swedish Industrial Standard (SIS) 2301 which includes 12–14% chromium, 0.15 to 0.35% carbon, maximum 1% manganese, up to about 0.5% Ni, and ordinary impurities. Other typical chromium -13 steels include ASME code 410 and 420.

Chromium -13 steels are preferred because of their normal potential, sprayability, strength, and elasticity.

The next or surface layer has a normal potential higher than the intermediate layer and is preferably substantially the same as or somewhat better than that of coopper (see Table 23-1 on page 23-3 of Chemical Engineer's Handbook, ibid).

When selecting a suitable surface layer, properties of mechanical strength versus tensive strength and resistance to erosion and sprayability can be considered.

Examples of some suitable surface layers include stainless or acidproof steel with about 18% chromium, 5 to 8% nickel, and optionally about 8% manganese, such as 18-8 (chromium/nickel) stainless steels (passive or oxidized), and 18-8-3 stainless steels (passive or oxidized), high nickel content steels such as alloys of 70–75% Ni, 15–17% Cr, 8–10% Fe, and Inconel with 30–40% Ni, 20% Cr, and 40–50% Fe. The stainless steels of the surface layer generally contain about 0.10% carbon and preferably only normal impurities in addition to alloying materials recited. The preferred steels for the surface layer are the 18-8 stainless steels.

The total thickness of the intermediate and surface layer together should not exceed about 3 mm to assure that the base layer is able to securely hold these layers. The total thickness of the three layers should not be less than about 500 microns to obtain sufficient tightness in view of the fact that the thermal spraying is normally performed manually, resulting in variations in thickness. At thicknesses less than about 500 microns (e.g., about 400 microns), there exists a risk of pores in the layers all of the way through to the steel surface. The intermediate and surface layers can be approximately of the same thickness but this is not essential. In fact, the ratio of thickness of the intermediate layer to that of the surface layer can be about 1:10 to about 10:1 and more desirably about 1:4 to about 4:1. Preferably, the intermediate and surface layers should each be at least about 200 microns.

The steel surface is that of the particular item such as that of turbine casings, large vapor tubes and the like, which are normally made of soft iron (mild steel, see the table of Chemical Engineer's Handbook, ibid) with rather a small content of carbon, up to a maximum of 0.20–0.30%, and very little alloying materials. A typical example of a steel surface has a normal potential about that of pure iron (i.e., about −0.44 volts). The thickness of the steel surface is dependent primarily upon the use of the particular item and is generally several centimeters, i.e., very much thicker than the protective layers.

If desired, a varnish which may include a metallic pigment can be sprayed onto or brushed onto the final surface layer to fill any pores therein. The varnish should be resistant to temperatures up to about 200° C. and good ability to penetrate into the metallic layers. Examples of suitable varnishes are phenol resin varnishes such Metcoseal AP commercially available from Metco, Inc., 1101 Prospect Avenue, Westbury, Long Island, N.Y., which is an air drying, oil modified phenolic resin varnish and silicon varnishes. If desired, the varnish can include a metallic pigment such as aluminum. This varnish should have a good penetrating ability into possible pores of the surface layer, since varnish lying outside the surface layer is rapidly worn off by the steam current and therefore is of no use.

The metallic layers are preferably applied to the steel surface by well known thermal spraying techniques (e.g., spraying under flame or plasma conditions). Coating materials employed in the present invention are available in the form of threads or thin rods and sometimes in the form of powders. If desired, the adhesion between the steel surface and base layer can be improved by roughening the steel surface such as by sandblasting. All percentages stated hereinabove are by weight unless the contrary is indicated.

What is claimed is:

1. A steel surface coated with a protective coating which comprises at least three adjacent metallic layers of substantially increasing normal potential under the expected conditions of use in the presence of hot moist steam wherein the normal potential of the base layer adjacent the steel surface is the lowest of the three metallic layers and the normal potential of that layer located farthest from the steel surface of said at least three metallic layers is the highest of the three metallic layers; and wherein the base layer lying on the steel surface has approximately the same normal potential as does the steel surface, and wherein said base layer is at least one member selected from the group consisting of nickel-aluminum alloy, nickel, and molybdenum.

2. The coated steel surface of claim 1 wherein said protective coating is a thermally sprayed coating.

3. The steel surface of claim 1 wherein said base layer is nickel aluminide.

4. The steel surface of claim 1 wherein the maximum thickness of said base layer is about 100 microns.

5. The steel surface of claim 1 wherein said base layer is about 10 to about 50 microns thick.

6. The steel surface of claim 1 wherein the layer intermediate between said base layer and the layer farthest from the steel surface has a normal potential higher than that of cast iron.

7. The steel surface of claim 1 wherein the layer intermediate between said base layer and the layer farthest from the steel surface is a chromium steel containing 10-15% by weight chromium.

8. The steel surface of claim 1 wherein the layer between said base layer and the layer farthest from the steel surface is a chromium steel containing about 13% by weight chromium.

9. The steel surface of claim 1 wherein the layer between said base layer and the layer farthest from the steel surface is a chromium steel comprising 12-14% chromium, 0.15-0.35% carbon, 0.5% nickel, and maximum 1% manganese.

10. The steel surface of claim 1 wherein the surface layer which is farthest from said steel surface of all of said at least three metallic layers has a normal potential at least equal to that of copper.

11. The coated steel surface of claim 10 wherein said surface layer is at least one member selected from the group consisting of steel containing about 18% chromium and 5-8% nickel; alloy containing 70-75% nickel; 15-17% chromium and 8-10% iron; and alloy containing 30-40% nickel, 20% chromium, and 40-50% iron.

12. The steel surface of claim 10 wherein said surface layer is an 18-18 stainless steel (passive).

13. The steel surface of claim 10 wherein said surface layer is a stainless steel containing about 18% chromium, 5-8% nickel, and about 8% manganese.

14. The steel of claim 1 wherein the minimum thickness of said at least three metallic layers is about 500 microns.

15. The steel surface of claim 14 wherein the maximum total thickness of the surface layer which is farthest from said steel surface of all of said three metallic layers and the intermediate layer between said surface layer and said base layer is about 3 mm.

16. The steel surface of claim 15 wherein said surface layer and said intermediate layer each is at least about 200 microns thick.

17. The steel surface of claim 15 wherein the ratio of thickness of said surface layer to said intermediate layer is about 1:10 to about 10:1.

18. The steel surface of claim 15 wherein the ratio of thickness of said surface layer to said intermediate layer is about 1:4 to about 4:1.

19. The steel surface of claim 15 wherein the thickness of said surface layer and said intermediate layer are about equal.

20. The steel surface of claim 1 wherein said at least three metallic layers are applied by thermal spraying.

21. The steel surface of claim 1 wherein about one third of the total increase of the normal potential from the steel surface to the surface layer farthest from said steel surface is provided by each of the three metallic layers.

22. The steel surface of claim 1 wherein the surface layer which is farthest from the steel surface is covered with a varnish.

23. The steel surface of claim 20 wherein said varnish contains at least one member selected from the group consisting of phenolic resins and silicones.

24. The steel surface of claim 23 wherein said varnish further includes a metallic pigment.

25. The steel surface of claim 24 wherein said pigment is aluminum.

* * * * *